US010273606B2

(12) United States Patent
Turner

(10) Patent No.: US 10,273,606 B2
(45) Date of Patent: Apr. 30, 2019

(54) CIRCULAR KNITTED GARMENT FOR LOWER TORSO

(71) Applicant: NIKE, Inc., Beaverton, OR (US)

(72) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 130 days.

(21) Appl. No.: 14/640,487

(22) Filed: Mar. 6, 2015

(65) Prior Publication Data

US 2016/0258086 A1 Sep. 8, 2016

(51) Int. Cl.

| | |
|---|---|
| ***D04B 1/24*** | (2006.01) |
| ***A41B 9/00*** | (2006.01) |
| ***A41D 1/08*** | (2018.01) |

(52) U.S. Cl.

CPC ..... *D04B 1/243* (2013.01); *A41B 9/001* (2013.01); *A41D 1/08* (2013.01); *A41D 2500/10* (2013.01)

(58) Field of Classification Search

CPC . D04B 1/243; D04B 9/46; D04B 9/42; D04B 9/48; D04B 9/50; D04B 1/24; A41B 9/04; A41B 11/01; A41B 9/00; A41B 9/001; A41B 9/02; A41B 11/00; A41C 1/003; A41D 1/06; A41D 1/08; A41D 1/088; A41D 2500/10

USPC .... 66/177, 175; 2/78.1, 402, 404, 78.2, 400; 450/104, 153

See application file for complete search history.

(56) References Cited

U.S. PATENT DOCUMENTS 1,278,693 A * 9/1918 Leszczynski ..... A41B 9/02 2/404
1,462,564 A * 7/1923 Weiner ..... A41B 9/04 2/402
1,476,247 A * 12/1923 Green ..... A41D 7/005 2/238
1,490,034 A * 4/1924 Shaner ..... A41B 9/08 2/78.1
1,604,832 A * 10/1926 Moutram ..... A41B 9/04 2/407

(Continued)

FOREIGN PATENT DOCUMENTS

| | | |
|---|---|---|
| EP | 0407100 A1 | 1/1991 |
| EP | 1016746 A2 | 7/2000 |

OTHER PUBLICATIONS

International Search Report and Written Opinion dated May 20, 2016 for PCT Application No. PCT/US2016/020673, 13 pages.

(Continued)

*Primary Examiner* — Danny Worrell

(74) *Attorney, Agent, or Firm* — Shook, Hardy & Bacon L.L.P.

(57) ABSTRACT

Present aspects hereof are directed to a circular knitted garment for a lower torso, formed from a circular knitted tube of fabric. In some aspects, a bottom edge of the tubular fabric body includes an arched front cutout with generally convergent legs, and an arched back cutout with generally divergent legs. Upon sewing a seam between the arched front cutout and the arched back cutout, a vertical seam is aligned with a vertical axis of the tubular fabric body and a front rise of the garment is lower than a back rise of the garment. In further aspects, a bottom angled cutout along the bottom edge of the tubular fabric body provides a perpendicular alignment between the bottom edge of the garment and the vertical inseam of the garment.

19 Claims, 6 Drawing Sheets

(56) References Cited

U.S. PATENT DOCUMENTS 1,669,834 A * 5/1928 Middleman ..... A41B 9/04 2/238
1,764,252 A * 6/1930 Fessler ..... A41B 9/02 2/234
1,783,174 A * 12/1930 Ide ..... A41D 7/00 2/407
1,891,884 A * 12/1932 Tanner ..... A41B 9/004 2/237
1,917,213 A * 7/1933 Hastings ..... A41B 9/00 2/78.1
1,987,965 A * 1/1935 Meares ..... A41C 1/003 2/407
2,000,073 A * 5/1935 Goas ..... A41B 9/001 2/407
2,264,958 A * 12/1941 Smith ..... A41D 1/06 2/227
2,285,012 A * 6/1942 Burkey ..... D04B 1/243 2/402
2,320,408 A * 6/1943 Clark ..... A41B 9/004 2/231
2,348,242 A * 5/1944 Bullinger ..... A41B 9/04 2/402
2,437,511 A * 3/1948 Donaldson ..... A41B 9/04 2/407
2,511,720 A * 6/1950 Lacks ..... D04B 1/243 2/402
2,827,051 A * 3/1958 Severson ..... A41B 9/02 602/67
2,837,904 A * 6/1958 Scriggins ..... A41B 9/04 450/101
3,153,243 A 10/1964 Takako
3,246,649 A * 4/1966 Krieger ..... A41C 1/003 450/104
3,362,410 A * 1/1968 Jaggers, Jr. ..... A41C 1/003 450/116
3,375,530 A * 4/1968 Matthews ..... A41B 9/001 2/402
3,392,733 A * 7/1968 Blair ..... A41C 1/003 450/104
3,418,660 A * 12/1968 Shumate ..... A41B 9/02 2/404
3,491,375 A * 1/1970 Hester ..... A41B 9/02 2/402
3,566,410 A * 3/1971 Merk et al. ..... A41B 9/04 2/404
3,613,119 A * 10/1971 Sarmiento ..... A41B 9/04 2/407
3,629,871 A * 12/1971 Sarmiento ..... A41B 9/04 2/407
3,739,398 A * 6/1973 Sarmiento ..... A41B 9/04 2/407
4,302,853 A * 12/1981 Mesek ..... A41B 9/04 2/402
4,887,439 A * 12/1989 Tenconi ..... D04B 1/243 66/172 E
5,163,306 A * 11/1992 Boehm ..... A41B 9/004 2/406
5,377,507 A * 1/1995 Shima ..... D04B 1/24 66/172 R
5,398,346 A * 3/1995 Feinberg ..... A41B 9/004 2/400
5,590,548 A * 1/1997 Osborne ..... A41B 9/04 2/401
5,613,378 A * 3/1997 Popa ..... A41D 1/06 2/213
5,823,013 A * 10/1998 Lonati ..... D04B 1/243 66/176
5,836,179 A * 11/1998 van Laar ..... D04B 1/243 66/171
5,903,922 A * 5/1999 Vargason ..... A41B 9/001 2/114
6,018,822 A * 2/2000 Hernandez ..... A41B 9/02 2/405
6,192,717 B1 * 2/2001 Rabinowicz ..... D04B 1/243 66/171
6,260,209 B1 * 7/2001 St. Ange ..... A41D 1/06 2/227
6,490,890 B1 * 12/2002 Irvin ..... A41B 9/04 66/177
7,131,146 B2 * 11/2006 Chatman ..... A41B 9/08 2/211
7,354,424 B2 * 4/2008 Giloh ..... A61F 13/15804 2/400
7,526,929 B2 * 5/2009 Takamoto ..... A41B 11/14 66/177
8,171,571 B2 * 5/2012 Utaka ..... A41C 1/003 2/400
8,460,265 B1 * 6/2013 Calender ..... A61F 13/49006 2/401
9,655,388 B2 * 5/2017 Michel ..... A41D 1/00
2003/0140661 A1 * 7/2003 Bonnin ..... D04B 1/243 66/170
2009/0055998 A1 * 3/2009 Blumenfeld ..... A41B 9/14 2/403
2009/0083894 A1 * 4/2009 Causey-Gabbe ..... A41B 9/08 2/78.1
2009/0229311 A1 * 9/2009 Obadalova ..... D04B 1/243 66/175
2010/0235970 A1 * 9/2010 Rad ..... A41B 11/14 2/409
2012/0084903 A1 * 4/2012 Roberts ..... A41B 9/02 2/400
2012/0255105 A1 * 10/2012 Turner ..... A41D 13/0506 2/455
2013/0095730 A1 * 4/2013 Jensen ..... A41C 1/003 450/95
2014/0283285 A1 * 9/2014 Rivera ..... A41B 9/04 2/406
2014/0366247 A1 * 12/2014 Mize ..... A41D 1/06 2/236
2015/0284885 A1 * 10/2015 Turner ..... D04B 1/246 66/176
2015/0296891 A1 * 10/2015 Blibech ..... A41B 9/001 2/400
2016/0120248 A1 * 5/2016 Oliver ..... A41B 9/00 2/69
2016/0258086 A1 * 9/2016 Turner ..... D04B 1/243
2017/0065003 A1 * 3/2017 Chen ..... A41B 9/023
2017/0295855 A1 * 10/2017 Baez ..... A41D 1/06

OTHER PUBLICATIONS

International Preliminary Report on Patentability dated Sep. 21, 2017 in International Patent Application No. PCT/US2016/020673, 9 pages.

* cited by examiner

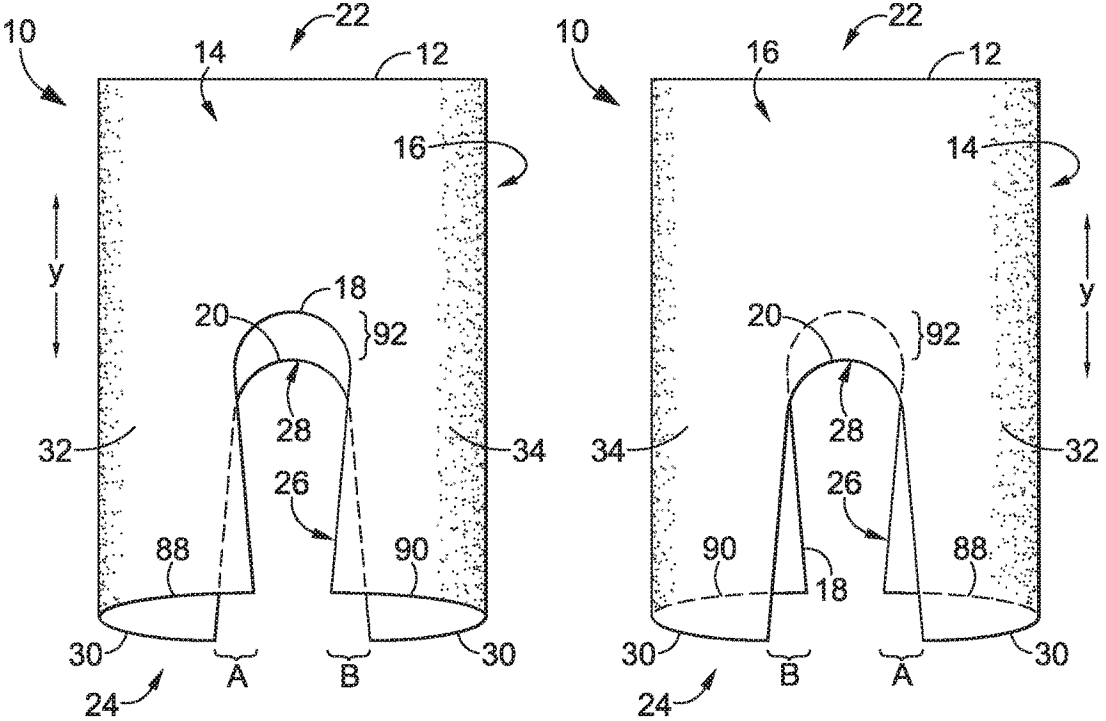
FIG. 1
FIG. 2
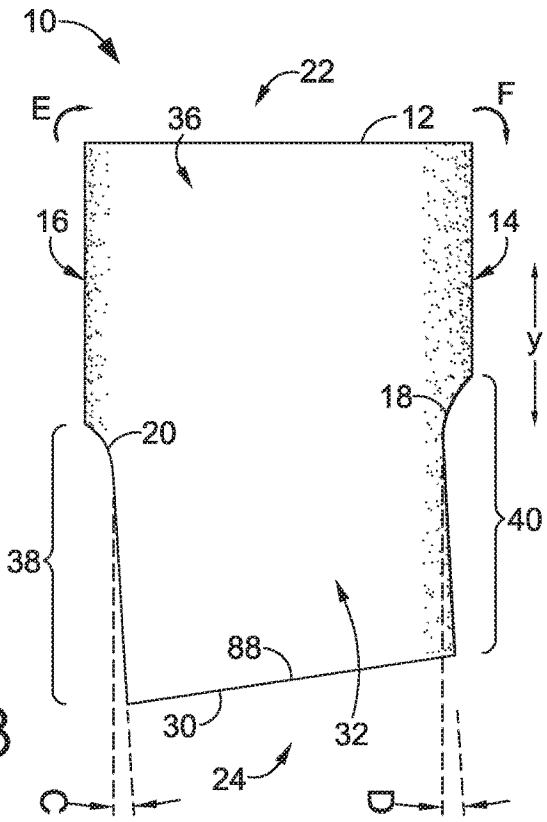
FIG. 3

CIRCULAR KNITTED GARMENT FOR LOWER TORSO

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Present aspects hereof relate to circular knitted apparel items. More specifically, exemplary aspects relate to a circular knitted garment for a lower torso that is sewn from a circular knitted tube, such as a pair of shorts or pants. Further aspects relate to a method of making a circular knitted garment for a lower torso, assembled from a single, tubular fabric body.

BACKGROUND

Athletic apparel may be constructed from a variety of materials chosen for optimal wear and enhanced athletic performance. The assembly of such materials may include the cutting and sewing of multiple pattern pieces, including numerous panels and seams formed from one or more materials that are configured into a fitted garment. Especially with respect to nonuniform garment patterns, multiple pattern pieces require the accurate orientation and sewing of multiple seams while constructing the fitted garment of a desired material.

SUMMARY

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter. Present aspects hereof are defined by the claims.

At a high level, present aspects hereof are directed toward a circular knitted garment for a lower torso. The lower torso garment is formed from a tubular fabric body and has a single seam that mates edges of front and back arched cutout portions of the tubular fabric body to provide leg openings. In one exemplary aspect, a tubular fabric body is formed from circular knitting of a fabric, from which an arched front portion and an arched back portion are removed along a portion of the lower edge of the tubular fabric body to provide front and back arched cutouts. In some aspects, one or more additional angled cutouts on the bottom edge of the tubular fabric body create an angled lower end of the tubular fabric body. In further aspects, an outer edge of a front arched cutout is mated to an outer edge of a back arched cutout, with the front arched cutout height being longer than the back arched cutout height with respect to the bottom edge of the tube. As such, upon sewing a single seam along the mated arched cutouts, a front rise of the front upper edge may be lower than the back rise of the back upper edge. Additionally, based on sewing the single seam along the mated arched cutouts, the angled cutout along the bottom edge of the tubular fabric body may shift to provide a bottom edge that is perpendicular to the vertical axis of the tubular fabric body.

In some aspects, the tubular fabric body may be constructed from a material having a particular thickness, weight, rigidity, and/or elasticity. Thus, with the edges of the front arched cutout mating to the edges of the back arched cutout, the tubular fabric body may conform to a wearer of the circular knitted garment while only having to sew a single seam along the inseam. In further aspects, a converging shape of the sides of the front arched cutout and a diverging shape of the sides of the back arched cutout provide a resulting seam that is aligned with a vertical axis of a portion of the garment.

Additional features of the tubular fabric body and corresponding cutouts improve the ease of assembly and the automatic alignment of the inseam with a vertical axis of the circular knitted garment.

BRIEF DESCRIPTION OF THE DRAWINGS

Examples are described in detail below with reference to the attached drawing figures, wherein:

FIG. 1 depicts a front view of an unassembled circular knitted garment for a lower torso, in accordance with an example of present aspects;

FIG. 2 depicts a back view of the circular knitted garment depicted in FIG. 1;

FIG. 3 depicts a right side view of the circular knitted garment depicted in FIG. 1;

DETAILED DESCRIPTION

Figure 5:
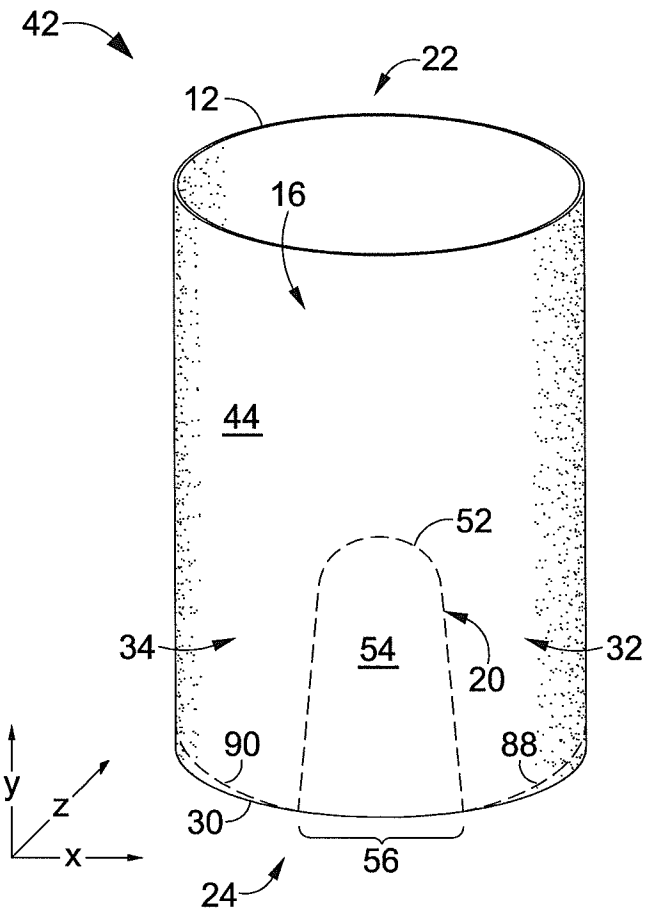
FIG. 5 depicts a back, perspective view of the tubular fabric body of FIG. 4.

Present aspects hereof are directed toward a circular knitted garment for a lower torso. The lower torso garment is formed from a tubular fabric body and has a single seam that mates edges of front and back arched cutout portions of the tubular fabric body to provide leg openings. In one exemplary aspect, a tubular fabric body is formed from circular knitting of a fabric, from which an arched front portion and an arched back portion are removed along a portion of the lower edge of the tubular fabric body to provide front and back arched cutouts. In some aspects, one or more additional angled cutouts on the bottom edge of the tubular fabric body create an angled lower end of the tubular fabric body. In further aspects, an outer edge of a front arched cutout is mated to an outer edge of a back arched cutout, with the front arched cutout height being longer than the back arched cutout height with respect to the bottom edge of the tube. As such, upon sewing a single seam along the mated arched cutouts, a front rise of the front upper edge may be lower than the back rise of the back upper edge. Additionally, based on sewing the single seam along the mated arched cutouts, the angled cutout along the bottom edge of the tubular fabric body may shift to provide a bottom edge that is perpendicular to the vertical axis of the tubular fabric body.

In some aspects, the tubular fabric body may be constructed from a material having a particular thickness, weight, rigidity, and/or elasticity. Thus, with the edges of the front arched cutout mating to the edges of the back arched cutout, the tubular fabric body may conform to a wearer of the circular knitted garment while only having to sew a single seam along the inseam. In further aspects, a converging shape of the sides of the front arched cutout and a diverging shape of the sides of the back arched cutout provide a resulting seam that is aligned with a vertical axis of a portion of the garment. Additional features of the tubular fabric body and corresponding arched cutouts may improve the ease of assembly and the automatic alignment of the inseam with a vertical axis of the circular knitted garment. In another aspect, the angled cutout along the bottom edge of the tubular fabric body automatically orients the bottom edge of the sewn garment into a perpendicular orientation with respect to the vertical axis and/or the sewn inseam between the mated arched cutouts. As such, a bottom edge of a pair of shorts and/or pants may be positioned perpendicular to the vertical axis of the sewn shorts and/or pants, once the cutout arched portions are aligned along the inseam.

Accordingly, in one aspect, a circular knitted garment for a lower torso includes a tubular fabric body having a fabric front, a fabric back, a tube top, a tube bottom, and a bottom edge. In further aspects, the garment includes a front arched cutout along at least a portion of the bottom edge of the fabric front of the tubular fabric body, with the front arched cutout having a front arched cutout height along a vertical axis of the tubular fabric body, wherein the front arched cutout comprises a front arched cutout edge. Additionally, the garment includes a back arched cutout along at least a portion of the bottom edge of the fabric back of the tubular fabric body, with the back arched cutout having a back arched cutout height along a vertical axis of the tubular fabric body, wherein the front arched cutout height is greater than the back arched cutout height, and further wherein the back arched cutout comprises a back arched cutout edge. In further aspects, the front arched cutout edge is coupled to the back arched cutout edge to provide an inseam, a right leg, and a left leg formed from at least a portion of the tubular fabric body.

In another exemplary aspect, a circular knitted garment for a lower torso includes a tubular knitted body having an upper edge, a lower edge, and a vertical axis. The circular knitted garment further includes a first arched cutout on at least a portion of the lower edge, a second arched cutout on at least a portion of the lower edge, said second arched cutout shorter than said first arched cutout, and an angled cutout on at least a portion of the lower edge. In some aspects, the second arched cutout is configured to mate to the first arched cutout such that a front portion of said upper edge is in a lower position than a back portion of said upper edge upon mating the first arched cutout to the second arched cutout to provide a sewn garment. Additionally, the lower edge of the sewn garment is perpendicular to the vertical axis based on the angled cutout.

In a further exemplary aspect, a method of making a garment for a lower torso from a circular knitted tube is provided. The method includes knitting a tubular fabric body in a circular direction, extracting a first portion of the tubular fabric body to provide a front cutout edge, extracting a second portion of the tubular fabric body to provide a back cutout edge, and sewing a seam between the front cutout edge and the back cutout edge to provide a first leg and a second leg of the garment.

In aspects hereof, FIGS. 1-6 illustrate an exemplary unassembled, circular knitted garment 10 for a lower torso. As shown in FIG. 1, an exemplary front view of a circular knitted garment 10 includes a tubular fabric body 12 with a fabric front 14 opposite a fabric back 16. In some aspects, while the tubular fabric body 12 is cylindrical in form, multiple different opposing surfaces of the tubular fabric body 12 may be used to provide a fabric front 14 and a fabric back 16. In further aspects, a front arched cutout 18 is formed by removal of a portion of the fabric front 14, while a back arched cutout 20 is formed by removal of a portion of the fabric back 16. As such, the front arched cutout 18 may be at least partially aligned with the back arched cutout 20 when viewed from the front. In one aspect, the front arched cutout 18 is an arch-shaped cutout having at least partially converging ends, while the back arched cutout 20 is an arch-shaped cutout having at least partially diverging ends.

In further aspects, as shown in the front view of FIG. 1 and the back view of FIG. 2, the tubular fabric body 12 includes a tube top 22 and a tube bottom 24 on opposing ends of the circular knitted garment 10. In one aspect, the tube top 22 provides an upper waistline portion of a lower torso garment (e.g., a pair of pants), while the tube bottom 24 provides a lower end for thigh and/or leg portions of the lower torso garment (e.g., pant legs). In one aspect, the front arched cutout 18 includes a front arched cutout edge 26 configured to mate to the back arched cutout edge 28 of back arched cutout 20. Upon knitting a single, tubular structure of the tubular fabric body 12, the portions of fabric that form the front arched cutout 18 and back arched cutout 20 may be removed from the tubular fabric body 12 along the bottom edge 30 of the tube bottom 24. In another aspect, at least a portion of the remaining tubular fabric body 12 (surrounding the front arched cutout 18 and the back arched cutout 20) may be used to define a right leg 32 and a left leg 34 of the tubular fabric body 12. Additionally, an angled cutout along the bottom edge 30 of the tubular fabric body 12 may be used to provide angled cutout edge 88 and angled cutout edge 90 of the tubular fabric body 12. As such, in the front view of FIG. 1, the front portion of the angled cutout edge 88 is higher than the back portion of the angled cutout edge 88, while the front portion of the angled cutout edge 90 is higher than the back portion of the angled cutout edge 90, as further depicted in FIGS. 2-3.

In some aspects, the front arched cutout 18 is offset from the back arched cutout 20 by a particular distance along the bottom edge 30 of the tubular fabric body 12. In further aspects, a bottom side portion of the arch-shaped front arched cutout 18 may be offset by a distance A along the bottom edge 30 with respect to the right leg 32 of the tubular fabric body 12. Similarly, a bottom side portion of the arch-shaped front arched cutout 18 may be offset by a distance B along the bottom edge 30 with respect to the left leg 34. Additionally, the top edge of the front arched cutout 18 is elevated a distance 92 above the top edge of the back arched cutout 20. As such, as shown in the side view of FIG. 3 from a right side 36 of the tubular fabric body 12, the fabric back 16 may include a back arched cutout 20 having a back cutout height 38 that is offset from the front cutout height 40 of the front arched cutout 18 on the fabric front 14. Such offset positioning, in some aspects, may provide an inseam that is aligned with the vertical axis y upon sewing of the front arched cutout edge 26 to the back arched cutout edge 28.

In another exemplary aspect, the edges of the bottom side portion of the arch-shaped back arched cutout 20 are offset at an angle C from the vertical axis y, while the edges of the bottom side portion of the front arched cutout 18 are offset at an angle D from the vertical axis y. In one exemplary aspect, the amount of offset of angles C and D corresponds to the distances A and B of the correlating fabric front 14 and fabric back 16. For example, with respect to the right leg 32 of the tubular fabric body 12, the distance A along the bottom edge 30 includes a difference between a side portion of the front arched cutout edge 26 cut at an angle D and a difference between a side portion of the back arched cutout edge 28 cut at an angle C. In some aspects, at least a portion of the front arched cutout edge 26 indirectly corresponds to at least a portion of the back arched cutout edge 28, by virtue of the angle and/or height of the front and back cutouts 18 and 20, when viewed from the front, back, and side, as in FIGS. 1-3.

In some aspects, at least a portion of the front arched cutout 18 overlaps with at least a portion of the back arched cutout 20, based on the partially-converging arch shape of the front arched cutout 18 and the partially diverging arch shape of the back arched cutout 20. Upon mating the back arched cutout 20 with the front arched cutout 18, in some aspects, the back side 16 of the tubular fabric body 12 shifts in a first direction E with respect to the vertical axis y. Additionally, the front side 14 of the tubular fabric body 12 shifts in a second direction F with respect to the vertical axis y.

Figure 4:
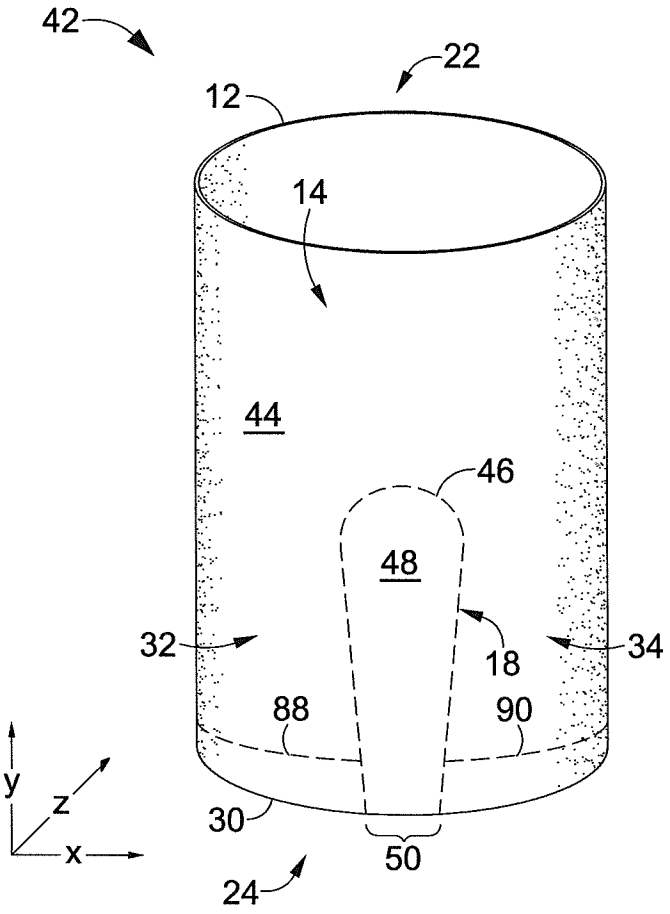
FIG. 4 depicts a front, perspective view of a tubular fabric body for making a circular knitted garment for a lower torso, in accordance with an example of present aspects.

With reference to the perspective views of circular knitted garment 42 in FIGS. 4-5, an exemplary tubular fabric body 12 includes a tube top 22 and a tube bottom 24 aligned vertically along a y-axis. Along an x-axis of the tubular fabric body 12, the garment fabric 44 may include a front cut border 46 that indicates the front arched cutout portion 48 having a bottom edge portion 50 along the bottom edge 30. In further aspects, as shown in FIG. 5, the garment fabric 44 may include a back arched cutout border 52 for removing the back arched cutout portion 54 having a bottom edge portion 56. In one aspect, the bottom edge portion 50 is less than the bottom edge portion 56. As such, during manufacture of a circular knitted garment 42, the tubular fabric body 12 may be formed from a single tube of material, from which the front arched cutout portion 48 and the back arched cutout portion 54 are removed. In one aspect, a perimeter of the front arched cutout portion 48 corresponds to the front arched cutout edge 26, while in further aspects, a perimeter of the back arched cutout portion 54 corresponds to the back arched cutout edge 28. In further aspects, based on removal of the front arched cutout portion 48 and the back arched cutout portion 54, the front arched cutout edge 26 may be configured to mate to the back arched cutout edge 28.

With continued reference to FIGS. 4-5, the angled cutout edge 88 and angled cutout edge 90 of the tubular fabric body 12 are shown having a first end at a first height with respect to the bottom edge 30, and a second end at a second height with respect to the bottom edge 30. In some aspects, the front portion of the angled cutout edges 88 and 90 is higher than the back portion of the angled cutout edges 88 and 90. The angled cutout edges 88 and 90, with the front portion of each angled cutout edge being higher than the back portion of each angled cutout edge as compared to the original bottom edge 30 of the tubular fabric body 12.

Figure 8:
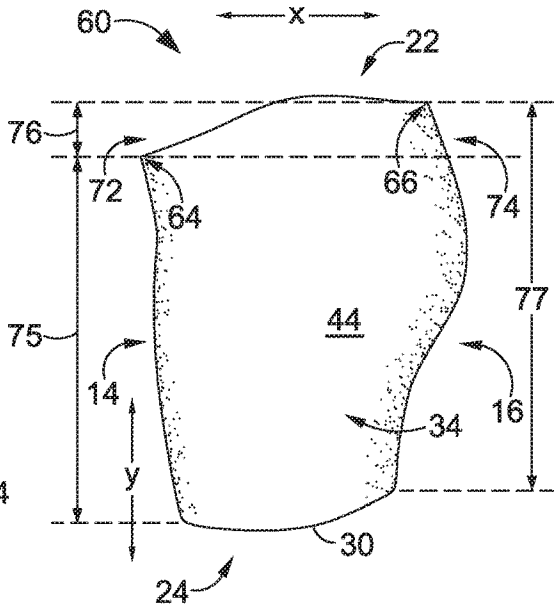
FIG. 8 depicts a side view of the assembled circular knitted garment of FIG. 7.
Figure 7:
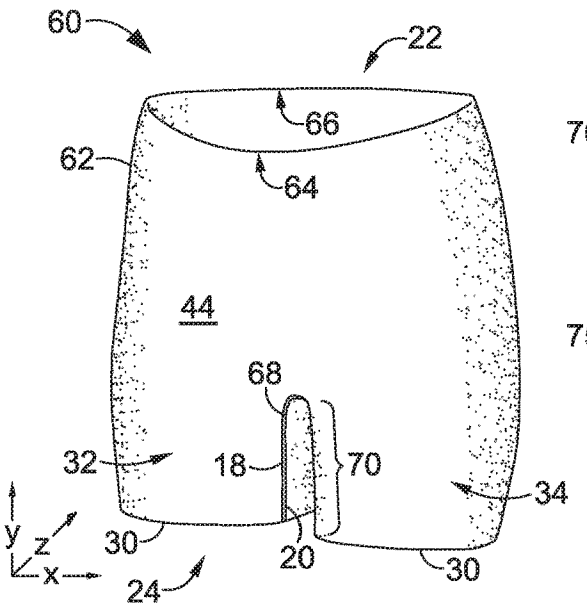
FIG. 7 depicts a front perspective view of an assembled circular knitted garment, in accordance with an example of present aspects.
Figure 6:
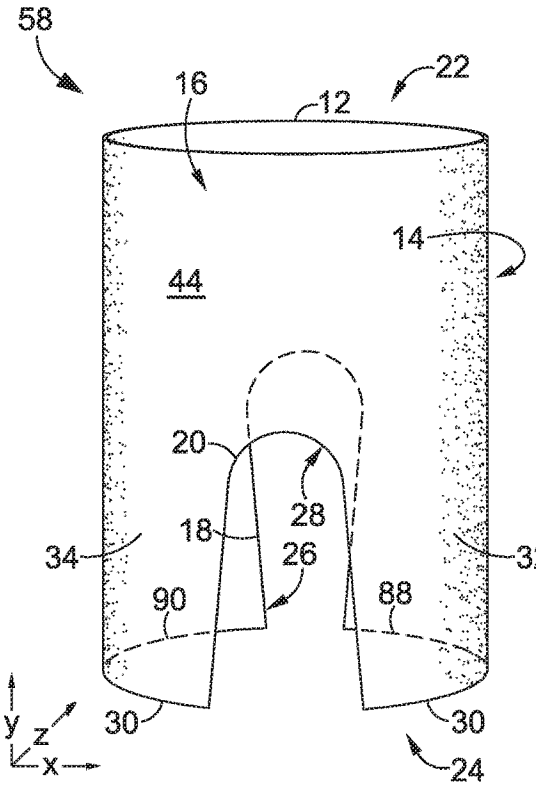
FIG. 6 depicts a back, perspective view of the tubular fabric body of FIG. 5 with front and back arched cutout portions removed, in accordance with an example of present aspects.

Turning next to the back perspective view of FIG. 6, an intermediate circular knitted garment 58 is shown during assembly, having the front cutout portion 48 and the back cutout portion 54 removed. As such, the front arched cutout edge 26 and back arched cutout edge 28 are exposed and configured to be sewn together, as shown in FIGS. 7-8. The assembled, circular knitted garment 60 shown in the perspective view of FIG. 7 includes a tubular fabric body 62 with a front upper edge 64 and a back upper edge 66 along the tube top 22. In some aspects, as shown in the example of FIG. 7, an inseam 68 having an inseam rise 70 is formed upon joining the front arched cutout edge 26 with the back arched cutout edge 28. As such, according to exemplary aspects, the orientation of the front arched cutout edge 26 and the back arched cutout edge 28 provides an off-center positioning of the tube top 22 with respect to the x axis, such that the front upper edge 64 is below the back upper edge 66. In one aspect, the sewing of the inseam 68 of the circular knitted garment 60 generates an amount of shifting of the tubular fabric body 62 (i.e., at least a portion of the fabric front 14) that is sufficient to displace the front upper edge 64 with respect to the back upper edge 66. As further shown along the bottom edge 30 of the right leg 32 and left leg 34 in FIG. 7, based on the angled cutout edges 88 and 90 (shown in FIGS. 1-5), the bottom edge 30 is shifted into a position perpendicular to the y axis of the tubular fabric body (i.e., parallel to the x axis depicted in FIG. 7) upon sewing of the inseam 68.

In the exemplary circular knitted garment 60 of FIG. 8, the front rise 72 is lower than the back rise 74 of the lower torso garment when viewed from a left side 34 of the tubular fabric body 62. As such, a fabric front 14 of the garment fabric 44 may be pulled down a distance 76 relative to a horizontal axis x of the tube top 22 upon sewing of the inseam 68. Further, the front upper edge 64 is positioned a first distance 75 away from the bottom edge 30 and the back upper edge 66 is positioned a second distance 77 away from the bottom edge 30, the second distance 77 being greater than the first distance 75. In some aspects, the single seam of the inseam 68 provides a central sewing location that divides the tube bottom 24 into the right leg 32 and the left leg 34 while at the same time shifting the garment fabric 44 to provide a lower front rise 72 compared to the higher back rise 74. As such, in some aspects, the circular knitted garment of FIGS. 7-8 is formed from a single, cylindrical and/or tubular body of fabric while eliminating any excess pattern pieces for sewing together.

In some aspects, the right leg 32 and/or the left leg 34 may be any length of cylindrical and/or tubular portions of the circular knitted garment 60 that meet at the inseam 68 formed between front arched cutout edge 26 and back arched cutout edge 28. A portion of the inseam 68 associated with the right leg 32 includes a sewn portion of a first segment of the front arched cutout edge 26 and a first segment of the back arched cutout edge 28, while the portion of the inseam 68 associated with the left leg 34 includes a sewn portion of a second segment of the front arched cutout edge 26 and a second segment of the back arched cutout edge 28. As shown in the example of FIG. 7, such sewn inseam dividing the left leg 34 and the right leg 32 may be aligned with a vertical y axis of the circular knitted garment 60, such as being positioned in a plane generally parallel to the body of the circular knitted garment 60 (i.e., straight up and down). In creating such alignment during inseam sewing, the angled cutout edges 88 and 90 along the bottom edge 30 of the tubular fabric body 62 provide an adjusted bottom edge 30 that is perpendicular to the inseam 68. As such, the bottom edge 30 of the right leg 32 and the left leg 34 may appear horizontal on a wearer of the circular knitted garment 60.

Figure 9:
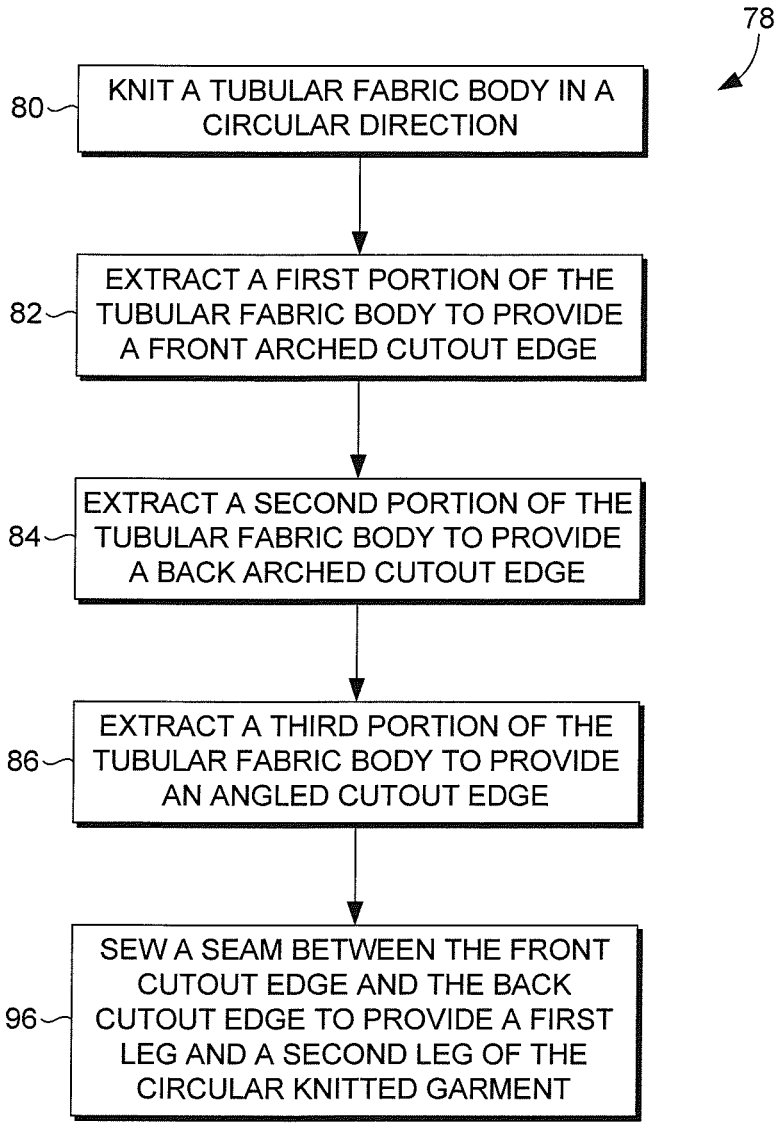
FIG. 9 includes a flow diagram of a method for manufacturing a circular knitted garment for a lower torso, in accordance with an example of present aspects.

Turning now to the flow diagram of FIG. 9, a method 78 for manufacturing a circular knitted garment for a lower torso is provided, according to exemplary aspects. At block 80, a tubular fabric body is knit in a circular direction. In one aspect, a seamless tube of fabric may be formed, from which a garment for a lower torso is manufactured without disassembling the structure of the tube. In one example, a tubular fabric body is formed during knitting in consecutive circles around a central, vertical axis, which therefore provides a knitted structure including a tube top for forming a waist of the lower torso garment and a tube bottom for forming the right and left legs.

At block 82, a front cutout portion of the tubular fabric body is extracted to provide a front arched cutout edge. As in previous examples, the front arched cutout portion removed from the fabric front of the tubular fabric body may have a particular front cutout height. At block 84, a back arched cutout portion of the tubular fabric body is extracted to provide a back arched cutout edge. As such, the back arched cutout portion removed from the fabric back of the tubular fabric body may have a particular back cutout height. In one exemplary aspect, the front cutout height is greater than the back cutout height with respect to an original bottom edge of the tubular fabric body, while a perimeter of the front arched cutout edge is configured to mate to a perimeter of the back arched cutout edge during sewing of a single seam.

In some aspects, at block 86, a third portion of the tubular fabric body is extracted to provide an angled cutout edge. The angled cutout edge may provide an altered bottom edge of the tubular fabric body, such that the bottom edge once oriented along an x axis of the tubular fabric body is now oriented diagonally with respect to the central y axis.

In another aspect, the front cutout edge is an arch-shaped edge having two end portions that are converging. In further aspects, the back cutout edge is an arch-shaped edge having two portions that are diverging. Accordingly, at block 96, an inseam is sewn between the front arched cutout edge and the back arched cutout edge to provide a first leg and a second leg of the circular knitted garment. In some aspects, upon sewing the seam between the front arched cutout edge and the back arched cutout edge, a front upper edge of the tubular fabric body corresponding to the fabric front is shifted downward, in the direction of the bottom edge of the tubular fabric body, while the back upper edge remains oriented near the tube top of the tubular fabric body. Based on such shifting, in some aspects, a front rise at a waistline of the circular knitted garment is lower than a back rise of the waistline of the circular knitted garment.

Figure 10:
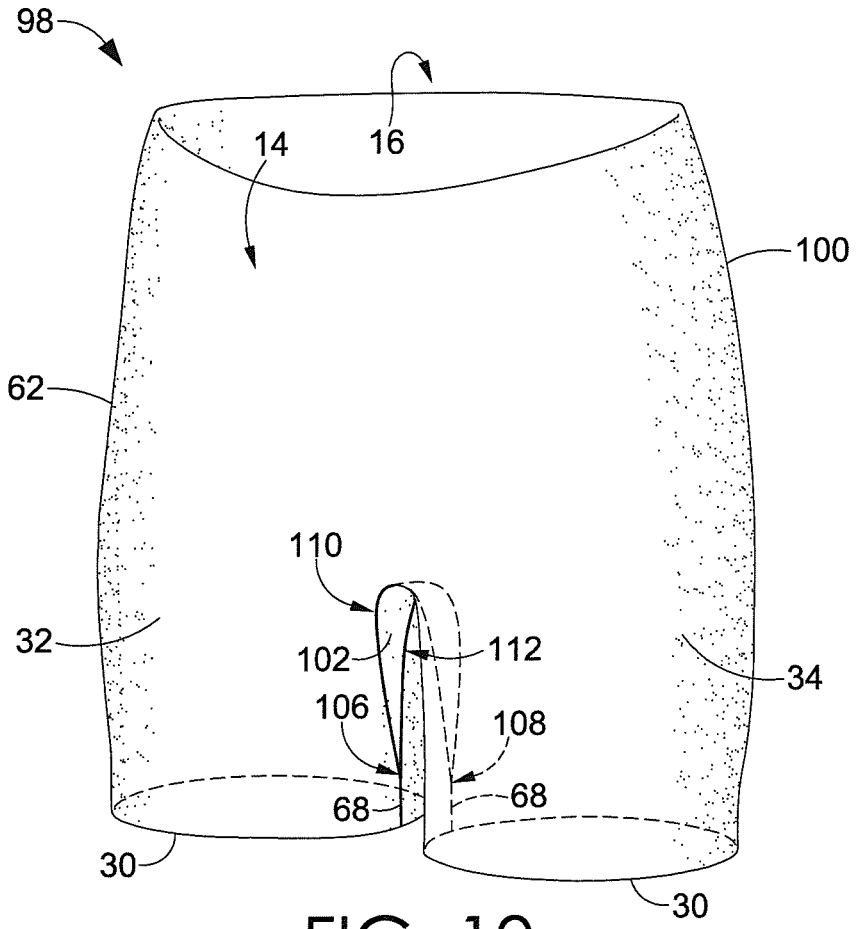
FIG. 10 depicts a front perspective view of an assembled circular knitted garment with a crotch gusset at a seam of the garment, in accordance with an example of present aspects.

Referring next to FIGS. 10-13, aspects of an assembled circular knitted garment 98 include a garment body 100 having an additional panel and/or portion of fabric, such as a crotch gusset 102, coupled to at least a portion of the assembled circular knitted garment 98. For example, FIG. 10 depicts a front perspective view of an assembled circular knitted garment 98 with a garment body 100 including a crotch gusset 102 coupled to the tubular fabric body 62 along at least a portion of the inseam 68, in accordance with an example of present aspects. In one aspect, the crotch gusset 102 may be configured to couple to at least a portion of the inseam 68, between the right leg 32 and the left leg 34. For example, the crotch gusset 102 may be configured to mate to at least a portion of the first arched cutout and at least a portion of the second arched cutout.

Figure 11:
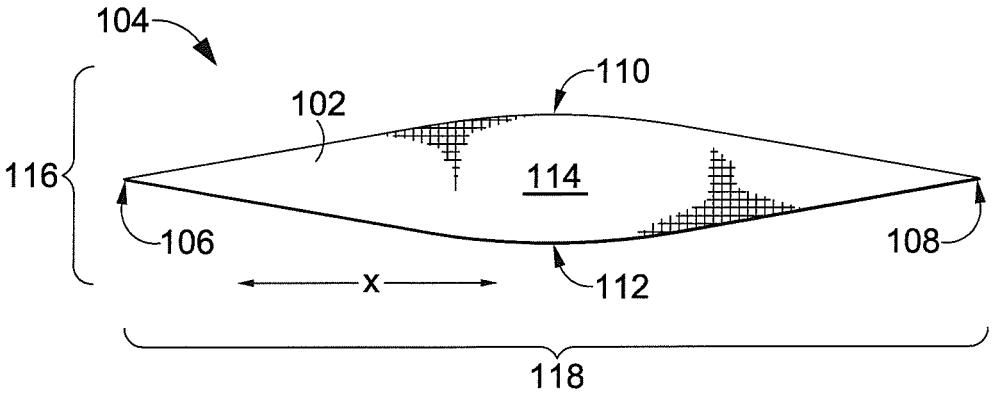
FIG. 11 depicts a top view of a crotch gusset, in accordance with an example of present aspects.

The top view 104 of FIG. 11 depicts the crotch gusset 102 having a crotch fabric 114 with a first end 106 opposite a second end 108 along a longitudinal axis x with a length 118 and a width 116. In some aspects, the edges of the crotch fabric 114 form an ellipse shape along the x axis. As such, the crotch gusset 102 may be integrated into the assembled circular knitted garment 100 with the front edge 110 of the crotch gusset 102 coupled to the fabric front 14 of the tubular fabric body 62, and the back edge 112 of the crotch gusset 102 coupled to the fabric back 16 of the tubular fabric body 62.

Figure 12:
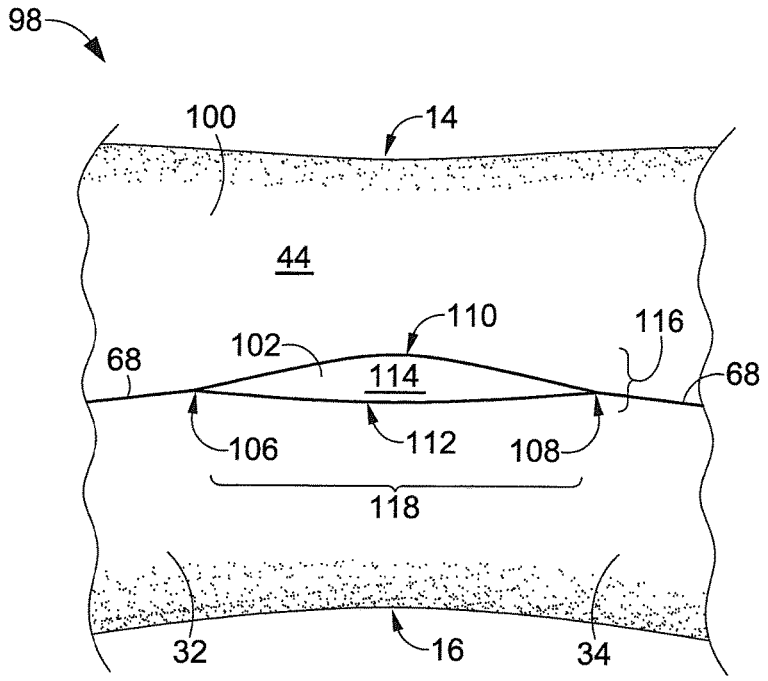
FIG. 12 depicts a bottom seam view of the assembled circular knitted garment t of FIG. 10.
Figure 13:
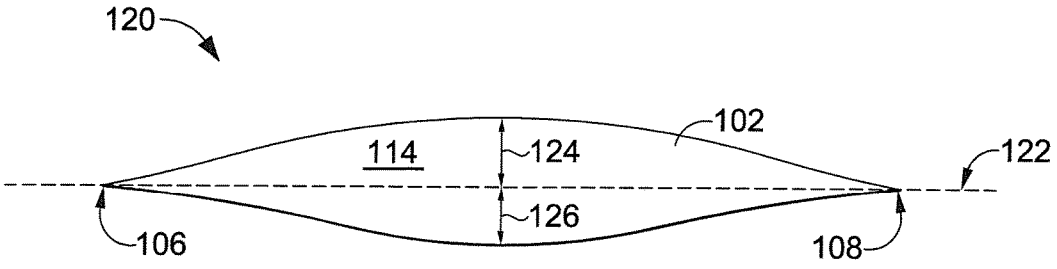
FIG. 13 depicts a bottom view of a crotch gusset, in accordance with an example of present aspects.

Finally, in the bottom view 120 of FIG. 12, the crotch gusset 102 includes a central axis 122 along which the front portion 124 and the back portion 126 are aligned. In one example, the front portion 124 and the back portion 126 are minor images of each other along the central axis 122. In another aspect, the front portion 124 is a different size and/or shape along the width 116 and/or length 118 of the crotch fabric 114. As such, in some aspects, the shape of the crotch gusset 102 (such as an ellipse shape) may be symmetrical or asymmetrical depending on each corresponding cutout edge along the inseam 68 of the tubular fabric body 62 and resulting assembled circular knitted garment 100. For example, the front portion 124 may be a different configuration than the back portion 126 based on the intended incorporation of the crotch gusset 102 into the intermediate circular knitted garment 58. As such, a particular shape and/or orientation of the crotch gusset 102 may provide a particular corresponding front rise or back rise of the assembled circular knitted garment 100. Further, a size of the assembled circular knitted garment 100 may correspond to a size of the crotch gusset 102 and/or a size of the tubular fabric body 62 coupled to the respective crotch gusset 102.

According to some aspects, the crotch gusset 102 may be coupled to at least a portion of the inseam 68 to provide additional space and/or range of motion for a user wearing the assembled circular knitted garment. As such, while the front arched cutout portion 48 provides a front cut border 46 for coupling at least in part to the perimeter of the crotch gusset 102 (e.g., coupling to the front edge 110 of the crotch gusset 102 to the front arched cutout 18), the back arched cutout portion 54 provides a back cut border 52 for coupling at least in part to the perimeter of the crotch gusset 102 (e.g., coupling to the back edge 112 of the crotch gusset 102 to the back arched cutout 20). In some aspects, at least a portion of the front arched cutout edge 26 may be cut having particular dimensions corresponding to the front edge 110 of the crotch gusset 102. Similarly, at least a portion of the back arched cutout edge 28 may be cut having particular dimensions corresponding to the back edge 112 of the crotch gusset 102.

Aspects of the crotch gusset 102 may be any material configured to couple to the tubular fabric body 62 of the assembled circular knitted garment 100. As such, in one aspect, the crotch gusset 102 includes a crotch fabric 114 that is the same as the garment fabric 44 used to provide the tubular fabric body 12 of the circular knitted garment 42. In another aspect, the crotch gusset 102 includes a crotch fabric 114 that is a different fabric other than the garment fabric 44, such as a moisture-wicking and/or vented fabric that promotes user comfort while wearing. The crotch fabric 114 may have one or more features configured to facilitate assembly and/or use of the assembled circular knitted garment 100, according to one aspect. As such, while the crotch gusset 102 is configured to conform to at least a portion of a user wearing the assembled circular knitted garment 100, such fitted orientation (as viewed in FIG. 10) may correspond to the assembly of the perimeter of the crotch gusset 102 that mates the fabric front 14 to the front edge 110, and the fabric back 16 to the back edge 112.

Present aspects hereof have been described in relation to particular examples, which are intended in all respects to be illustrative rather than restrictive. From the foregoing, it will be seen that the present aspects are well adapted to attain all the ends and objects set forth above, together with other advantages, which are obvious and inherent to the system and method. It will be understood that certain features and subcombinations are of utility and may be employed without reference to other features and subcombinations. This is contemplated by and is within the scope of the claims.

What is claimed is:

1. A circular knitted article for a lower torso comprising:

a tubular fabric body comprising a tubular material, a fabric front configured to cover a front lower torso of a wearer, a fabric back configured to cover a back lower torso of the wearer, a front upper edge, a back upper edge that continuously extends from the front upper edge, the front upper edge and the back upper edge configured to encircle a waist of the wearer, and a bottom edge;

a front arched cutout along at least a portion of the bottom edge of the fabric front of the tubular fabric body, the front arched cutout having a front arched cutout height along a vertical axis of the tubular fabric body, wherein the front arched cutout comprises a front arched cutout edge of the tubular material;

a back arched cutout along at least a portion of the bottom edge of the fabric back of the tubular fabric body, the back arched cutout having a back arched cutout height along the vertical axis of the tubular fabric body, wherein the back arched cutout comprises a back arched cutout edge of the tubular material; and a seam that couples the entire length of the front arched cutout edge to the entire length of the back arched cutout edge to provide a single inseam along the vertical axis, a right leg, and a left leg formed from at least a portion of the tubular fabric body;

wherein the front upper edge of the circular knitted article is positioned a first distance away from the bottom edge and the back upper edge is positioned a second distance away from the bottom edge, the second distance being greater than the first distance.

2. The circular knitted article of claim 1, wherein the tubular fabric body comprises a knit fabric formed from a single tubular structure knitted in a circular direction around a central axis.

3. The circular knitted article of claim 2, wherein the fabric front of the tubular fabric body comprises at least a portion of a knitted surface of the tubular fabric body viewed from a first side of the tubular fabric body in a vertical orientation, and further wherein the fabric back of the tubular fabric body comprises a knitted surface of the tubular fabric body viewed from a second side of the tubular fabric body in the vertical orientation, the second side opposite said first side.

4. The circular knitted article of claim 1, wherein:

the front upper edge of the fabric front of the tubular fabric body corresponds to a front rise of the circular knitted article; and the back upper edge of the fabric back of the tubular fabric body corresponds to a back rise of the circular knitted article.

5. A circular knitted article for a lower torso comprising:

a tubular knitted body having a tubular knit material, a fabric front configured to cover a front lower torso of a wearer, a fabric back configured to cover a back lower torso of the wearer, a continuous upper edge configured to encircle a waist of the wearer, a bottom edge, and a vertical axis;

a front arched cutout of the tubular knit material, the front arched cutout located on at least a portion of the bottom edge;

a back arched cutout of the tubular knit material, the back arched cutout located on at least a portion of the bottom edge; and a single, continuous inseam that couples the entire length of the front arched cutout to the entire length of the back arched cutout such that a front portion of the upper edge of the circular knitted article is in a lower position than a back portion of the upper edge of the circular knitted article upon coupling the front arched cutout to the back arched cutout, wherein the bottom edge of the circular knitted article is perpendicular to the vertical axis and further wherein:

the front portion of the upper edge of the circular knitted article is positioned a first distance from the bottom edge and the back portion of the upper edge of the circular knitted article is positioned a second distance from the bottom edge, the second distance being greater than the first distance.

6. The circular knitted article of claim 5, wherein at least a portion of the single, continuous inseam is parallel to the vertical axis.

7. The circular knitted article of claim 1, wherein the circular knitted article is seamless except for the single inseam.

8. The circular knitted article of claim 1, wherein the bottom edge of the circular knitted article is perpendicular to the vertical axis.

9. The circular knitted article of claim 1, wherein the circular knitted article is formed from a single tube of material.

10. The circular knitted article of claim 1, wherein the front arched cutout height is the same as the back arched cutout height.

11. The circular knitted article of claim 5, wherein the circular knitted article is seamless except for the single, continuous inseam.

12. The circular knitted article of claim 5, wherein the circular knitted article is formed from a single tube of material.

13. A circular knitted tube for forming a lower torso garment, the circular knitted tube comprising:

a body in the form of a seamless tube, the body having at least an upper edge and a bottom edge;

a front arched-shaped cutout located along the bottom edge of the body at a front aspect of the body, the front arched-shaped cutout having a first height along a vertical axis of the body; and a back arched-shaped cutout located along the bottom edge of the body at a back aspect of the body, the back arched-shaped cutout having a second height along the vertical axis of the body, the first height of the front arched-shaped cutout greater than the second height of the back arched-shaped cutout, wherein:

the upper edge at the front aspect of the body is aligned with the upper edge at the back aspect of the body relative to a horizontal axis of the body, and a third height measured from the upper edge to the bottom edge at the front aspect of the body is less than a fourth height measured from the upper edge to the bottom edge at the back aspect of the body.

14. The circular knitted tube of claim 13, wherein the front arched-shaped cutout comprises a first end portion and a second end portion, and wherein the back arched-shaped cutout comprises a third end portion and a fourth end portion.

15. The circular knitted tube of claim 14, wherein the first end portion and the second end portion converge along the bottom edge of the body.

16. The circular knitted tube of claim 15, wherein the third end portion and the fourth end portion diverge along the bottom edge of the body.

17. The circular knitted tube of claim 13, wherein the circular knitted tube comprises a knit fabric formed from a single tubular structure knitted in a circular direction around the vertical axis.

18. The circular knitted tube of claim 13, wherein the upper edge forms a waist opening for the lower torso garment.

19. The circular knitted tube of claim 13, wherein the bottom edge forms a right leg opening and a left leg opening for the lower torso garment.

* * * * *